US008317908B2

(12) United States Patent
Fraden

(10) Patent No.: US 8,317,908 B2
(45) Date of Patent: Nov. 27, 2012

(54) TRIBOELECTRIC AIR PURIFIER

(75) Inventor: Jacob Fraden, San Diego, CA (US)

(73) Assignee: Kaz USA, Inc., Southborough, MA (US)

( * ) Notice: Subject to any disclaimer, the term of this patent is extended or adjusted under 35 U.S.C. 154(b) by 482 days.

(21) Appl. No.: 12/589,557

(22) Filed: Oct. 26, 2009

(65) Prior Publication Data

US 2010/0122629 A1 May 20, 2010

Related U.S. Application Data

(60) Provisional application No. 61/199,440, filed on Nov. 18, 2008.

(51) Int. Cl.
*B03C 3/10* (2006.01)

(52) U.S. Cl. ..... 96/94; 95/77; 96/17

(58) Field of Classification Search ..... 96/17, 39–42, 96/94; 95/77
See application file for complete search history.

(56) References Cited

U.S. PATENT DOCUMENTS

| | | | | |
|---|---|---|---|---|
| 1,396,811 | A * | 11/1921 | Chubb | 95/77 |
| 2,455,738 | A * | 12/1948 | Crise | 96/61 |
| 3,290,868 | A * | 12/1966 | Upor | 55/343 |
| 3,680,287 | A | 8/1972 | Wood et al. | |
| 3,763,633 | A | 10/1973 | Soltis | |
| 3,912,467 | A * | 10/1975 | Trump et al. | 96/94 |
| 4,098,578 | A * | 7/1978 | Stanton | 422/182 |
| 4,344,776 | A | 8/1982 | Yavnieli | |
| 5,277,703 | A * | 1/1994 | Sklenak et al. | 95/77 |
| 5,380,355 | A * | 1/1995 | Brothers | 96/64 |
| 5,423,903 | A * | 6/1995 | Schmitz et al. | 96/134 |
| 5,429,669 | A * | 7/1995 | Chang | 96/51 |
| 5,846,302 | A | 12/1998 | Putro | |
| 6,203,600 | B1 * | 3/2001 | Loreth | 96/40 |
| 6,958,088 | B1 * | 10/2005 | Moriyama | 96/39 |
| 7,297,185 | B2 * | 11/2007 | Furuta et al. | 96/39 |
| 8,029,601 | B2 * | 10/2011 | Franzen et al. | 95/77 |
| 2007/0295208 | A1 * | 12/2007 | Fairchild | 95/74 |

FOREIGN PATENT DOCUMENTS

| | | | | |
|---|---|---|---|---|
| JP | 53-5468 | A * | 1/1978 | 96/94 |

* cited by examiner

*Primary Examiner* — Richard L Chiesa
(74) *Attorney, Agent, or Firm* — Stroock & Stroock & Lavan LLP

(57) ABSTRACT

An air purifier has an air blower and a rotating brush, the brush having long flexible bristles made of a material that is capable of developing negative triboelectric charge. During a portion of the rotation cycle, the bristles move across a surface that can accumulate a positive charge. This causes the bristle to charge negatively. Air impurities are attracted to the negatively charged bristles and are discharged into a collecting bin.

15 Claims, 5 Drawing Sheets

TRIBOELECTRIC AIR PURIFIER

CROSS-REFERENCE TO RELATE APPLICATION

This application claims the benefit under 35 U.S.C. §119 (e) of U.S. Provisional Patent Application No. 61/199,440, filed on Nov. 18, 2008, which is hereby incorporated by reference herein in its entirety.

FIELD OF THE INVENTION

The present invention relates generally to devices for filtering air and specifically to electrostatic air filters.

DESCRIPTION OF THE PRIOR ART

In the following disclosure, the terms air filter, air purifier and air cleaner have the same meaning and are used interchangeably.

Nearly all residential dwellings and industrial facilities, as well as automobiles and other vehicles, incorporate some kind of air supply or air treatment system. These systems range from a simple ventilation duct to complex automatic air conditioning installations that may include heating, cooling and humidity control devices. Most of them use air filters to purify air. Many air suction devices, such as vacuum cleaners, also use air filters to separate the air from airborne soiling particles.

A typical air filter includes a supporting frame and a filtering mesh, often fabricated of paper, metal or polymer fibers. Clearances in the filter surface and body define the smallest size of the captured particles. Thus, for capturing small particles, the filter should be rather dense, which results in reduced air flow, requires a more powerful blower and increases noise. This type of an air filter is exemplified by the U.S. Pat. No. 5,423,903, issued to Schmitz et al., which is incorporated by reference herein in its entirety.

Other air filters, a passive type, rely on the electrostatic charge acquired by moving soiling particles and thus of these particles being attracted to oppositely charged filter fibers. These filters typically comprise a polymer material, as exemplified by U.S. Pat. No. 3,680,287, issued to Wood et al., which is incorporated by reference herein in its entirety. Passive electrostatic filters have low efficiencies due to substantial air flow resistances.

Other electrostatic filters are of an active type as they contain high-voltage power supplies and at least two electrically charged metal plates, as exemplified by the U.S. Pat. No. 3,763,633, issued to Soltis, and U.S. Pat. No. 5,846,302, issued to Putro, both of which are incorporated by reference herein in their entireties. Other electrostatic filters use air ionizers, as exemplified by U.S. Pat. No. 4,344,776, issued to Yavnieli, which is incorporated by reference herein in its entirety. A substantial drawback of these active electrostatic filters is the need for a high-voltage generator that adds cost. Besides, high voltages may potentially pose a danger to the user and may result in the generation of harmful ozone.

Thus it is a goal of this invention to provide an air filter that may capture various sizes of airborne particles.

Another goal of this invention is to provide an air filter having a low air flow resistance.

And another goal of this invention is to provide an air purifier that is easy to clean and requires less frequent changing of the filtrating parts.

Still another goal of the invention is to provide an air filter that is inexpensive and easy to fabricate. Other goals of the invention will become apparent from the following description.

SUMMARY OF INVENTION

Various embodiments of the invention are based on generating high voltages by using a triboelectric effect. High voltage electric charges are generated on the surfaces of polymer bristles of a rotating brush that touches the inner wall of the filter. A blower moves air near the rotating brush. Most of the airborne particles that are naturally positively charged are attracted to the negatively charged bristles. A grounded grid discharges and cleans the bristles while collecting dirt in a bin.

DETAILED DESCRIPTION

Many airborne soiling particles naturally carry a positive charge. Examples of such particles are microscopic scales of human skin, animal fur, wool, human hair, and dirt. Various embodiments of the present invention are based on the use of an electrically attractive force to capture the naturally charged soiling particles to electrically non-conductive fibers that are charged negatively. The negative charge is generated by a well known triboelectric effect when the fibers are rubbed against a surface and then separated.

Figure 1:
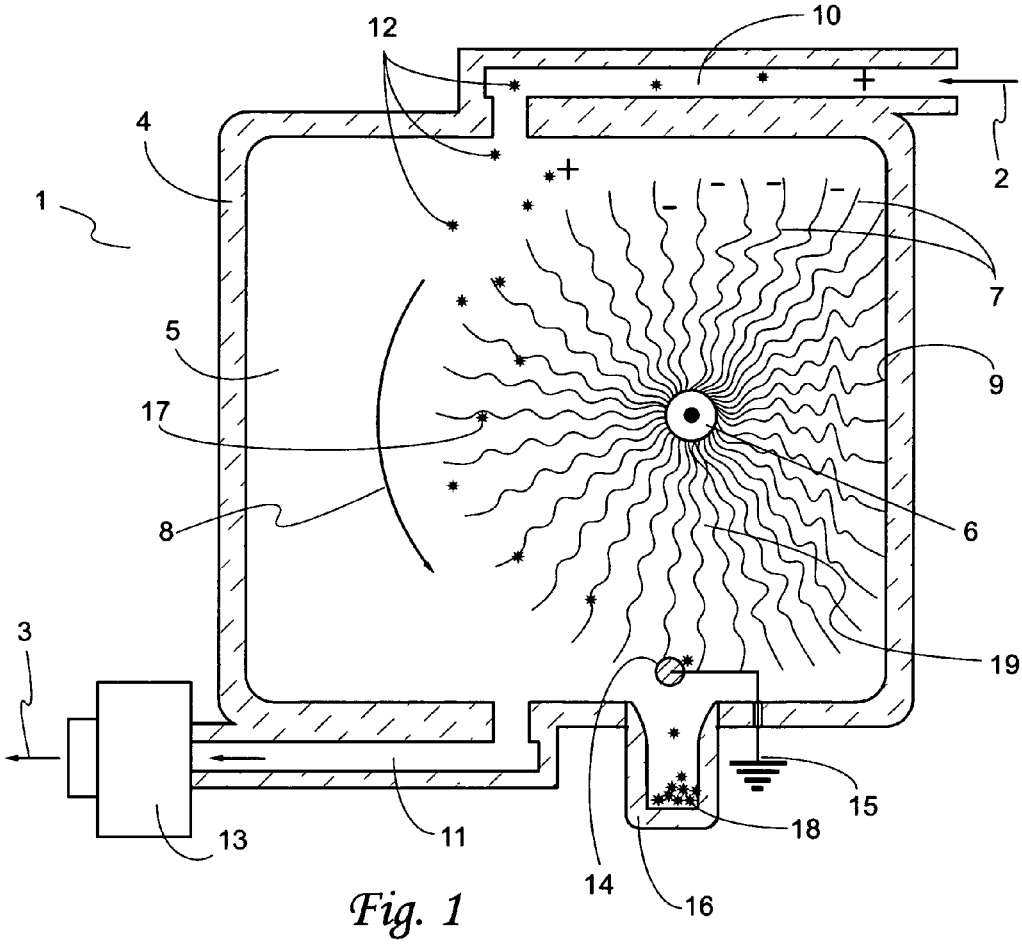
FIG. 1 is a cross-sectional view of an embodiment air cleaner with a rotating brush.

FIG. 1 illustrates a cross-sectional view of an air filtering device 1 (a single-chamber air purifier). The device 1 includes an enclosure 4 having an inner wall 9 that can be made of the same or different material as the body of the enclosure 4. An inner space 5 of the enclosure 4 contains a cylindrical brush 19 that can rotate around axis 6. The brush 19 is composed of a multitude of thin long bristles 7 carried by the axis 6. The brush 19 can rotate in direction 8 either freely (passively) or forcibly by an external rotating mechanism, such as an electric motor. While rotating, the bristles periodically brush against the inner wall 9 of the enclosure 4. In other words, the bristles contact the inner wall 9 only during the first phase of a rotating cycle. For example, the bristles may touch the walls 9 when the brush rotates from 0° to 180° ($1^{st}$ phase of rotation) and do not touch the wall while moving from 180° to 360° ($2^{nd}$ phase of rotation). The $1^{st}$ phase is for generating a negative charge on the bristles, while the $2^{nd}$ phase is for purifying air. The movement of the bristles across the wall 9 causes friction that results in a charge separation. Thus, by a suitable selection of materials for the inner wall 9 of enclosure 4 and bristles 7, the bristles become negatively charged when they are separated from the wall 9 in process of moving from $1^{st}$ phase to $2^{nd}$ phase during rotation. The bristles are preferably fabricated of a material that due to a triboelectric effect can develop a strong negative charge. Preferred materials for the bristles are fluoropolymer resins (Teflon), silicon, vinyl and polypropylene. However, other materials can be used as well albeit with a lesser efficiency. The bristle profile may be round or flat, but an effort is preferably made to maximize the surface area of the bristles. Round bristles preferably have a diameter on the order of 0.001" and are pliant and flexible. While the inner walls 9 may be triboelectrically neutral (not to generate a charge), for a better efficiency it is desirable for the walls 9 to develop a positive charge. Thus, preferred materials for the inner walls 9 are glass, quartz, and nylon. Aluminum, while still useful, is less desirable as it develops a rather weak positive charge.

Figure 8:
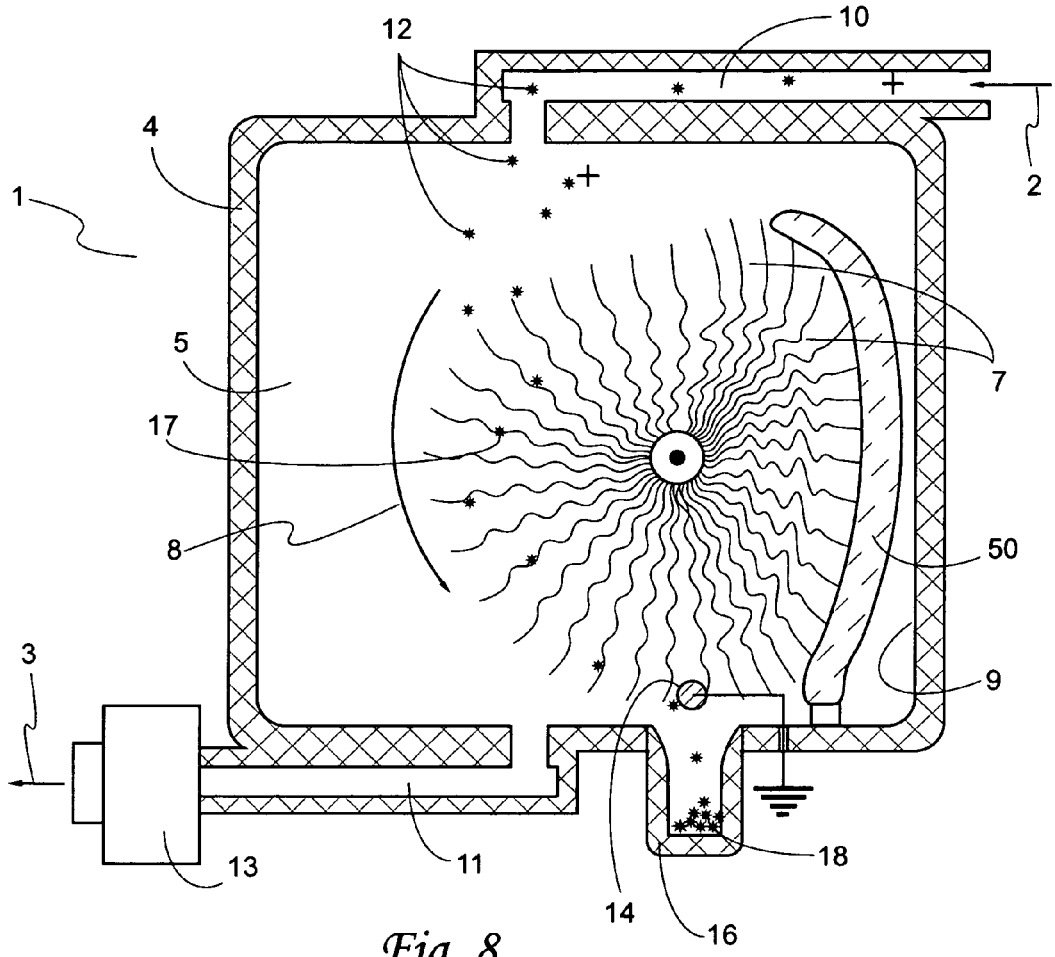
FIG. 8 shows an embodiment plate that causes development of negative charge on brush bristles according to an embodiment of the invention.

It is not necessary that the charge separation function be carried out by brush 19 moving against the wall 9. The same effect can be achieved by brush 19 moving bristles against a plate 50 that is positioned inside enclosure 4 and separated from the inner wall 9, as shown in FIG. 8. In this embodiment, the plate 50 is preferably fabricated from the same materials as listed above with respect to the inner wall 9, while the inner wall 9 material becomes no longer critical and can be made of any metal or resin.

The enclosure 4 has two air ducts: at least one inlet 10 and at least one outlet 11. Dirty air 2 enters the inlet 10 and then moves into the inner space 5, passing by and through the rotating brush 19. It encounters little flow resistance. Dirty air carries the soiling particles 12 that are naturally positively charged. Since air moves near bristles 7 that now are charged negatively thanks to their brushing up against the inner wall 9 (or plate 50), particles 12 are attracted to the bristles 7, thus becoming attached particles 17. They are carried by the bristles in the direction 8. In the process of rotation within the $1^{st}$ phase, before moving to the inner wall 9 (or plate 50) the bristles pass by and brush against a discharge finger 14 that is grounded or connected to the enclosure 4. Soiling particles are removed from the bristles and drop into a collecting bin 16 that collects sludge 18.

Figure 2:
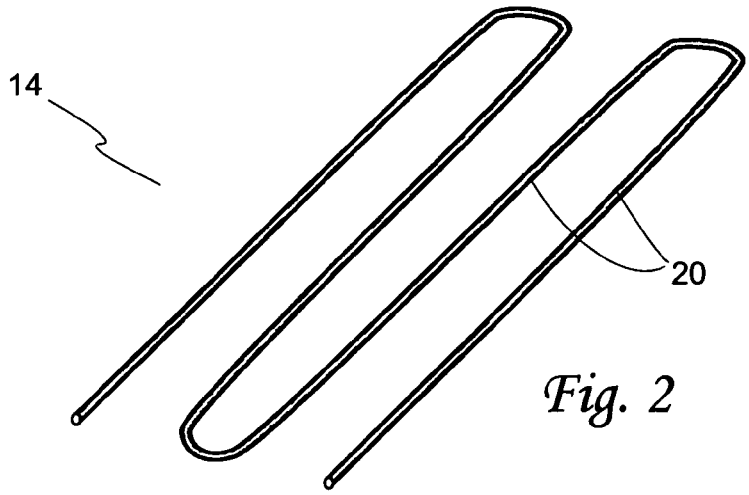
FIG. 2 shows an embodiment discharge grid.

The discharge finger 14 is preferably made of metal (for example, aluminum) and may be formed as serially connected rods 20 (as shown in FIG. 2). If the inner wall 9 is made of metal (such as aluminum), the discharge grid is then preferably electrically connected to it. If the wall 9 is electrically insulating, the finger 14 preferably should be grounded, as shown in FIG. 1, by ground 15.

Figure 3:
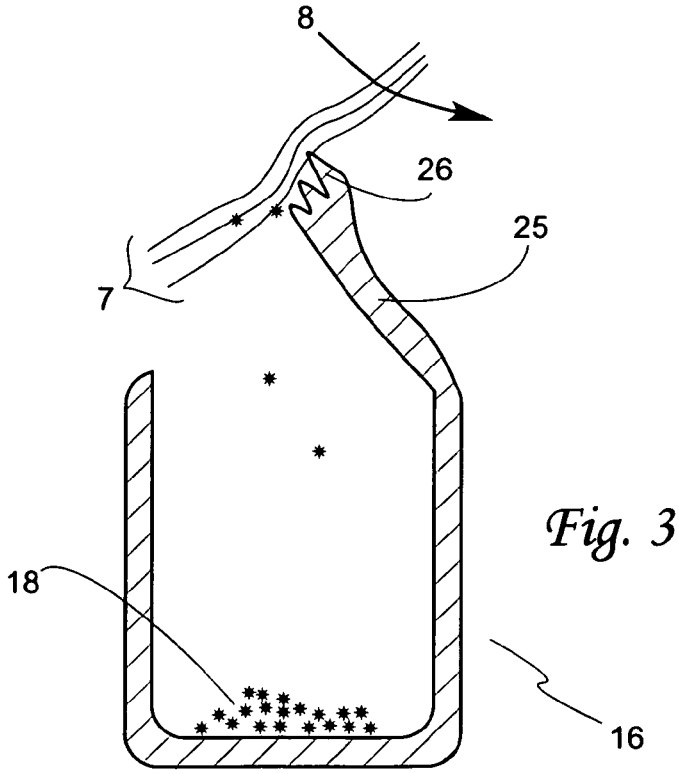
FIG. 3 depicts an embodiment collection bin with a scrapper.

Air is moved through inlet 10, the inner space 5 and outlet 11 by means of a forced convection caused by the air blower 13 that discharges clean air 3 into the environment or other space where clean air is utilized. If the brush 19 is freely and passively rotated, air moving through the inner space 5 will cause the brush rotation in direction 8. If the brush 19 is forcibly rotated, it may be driven by a separate or the same motor that is part of the blower 13. The bin 16 may be removable for cleaning. Note that the bin 16 and grid 15 may be combined in one device as shown in FIG. 3. Here bin 16 comprises scrapper 25 with fingers 26 that brush against the bristles 7 moving in direction 8. As a result of the mechanical action and discharge, soiling particles are collected at the bottom as sludge 18.

Figure 4:
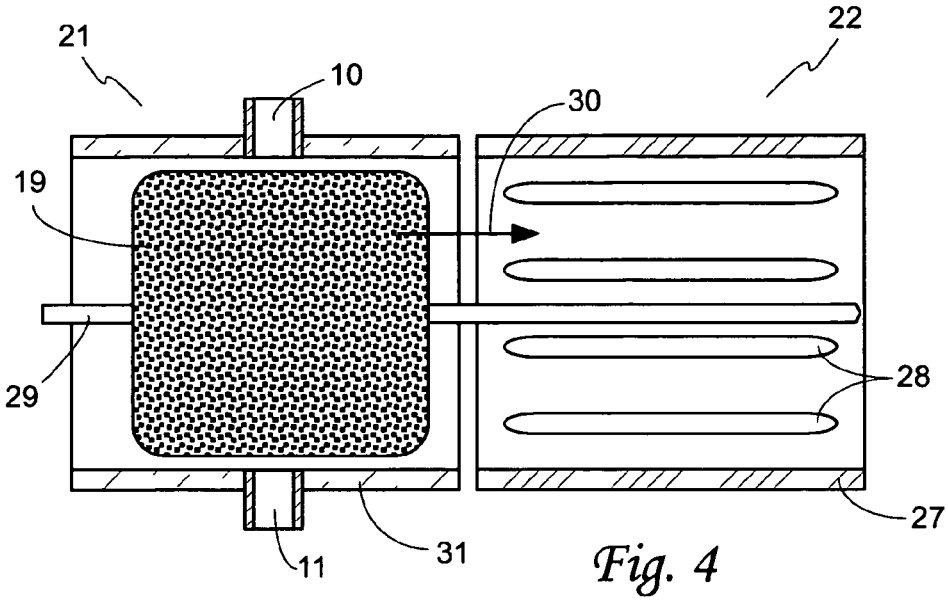
FIG. 4 illustrates an embodiment dual chamber air purifier.

Another method of removing dirty particles from the brush 19 is shown in FIG. 4. There are two adjacent sections 21 and 22. The first section 21 is comprised of enclosure 31 made of the first material (such as glass). The second section, which is the chamber 22, contains housing 27 made of a second material (such as polypropylene). The first and second materials should be different in the sign of the generated triboelectric charge. In other words, for best performance, the polarities of the triboelectric charges for the first and second materials should be opposite. Preferably, the second material should be selected from the same group as the bristles 7.

Figure 5:
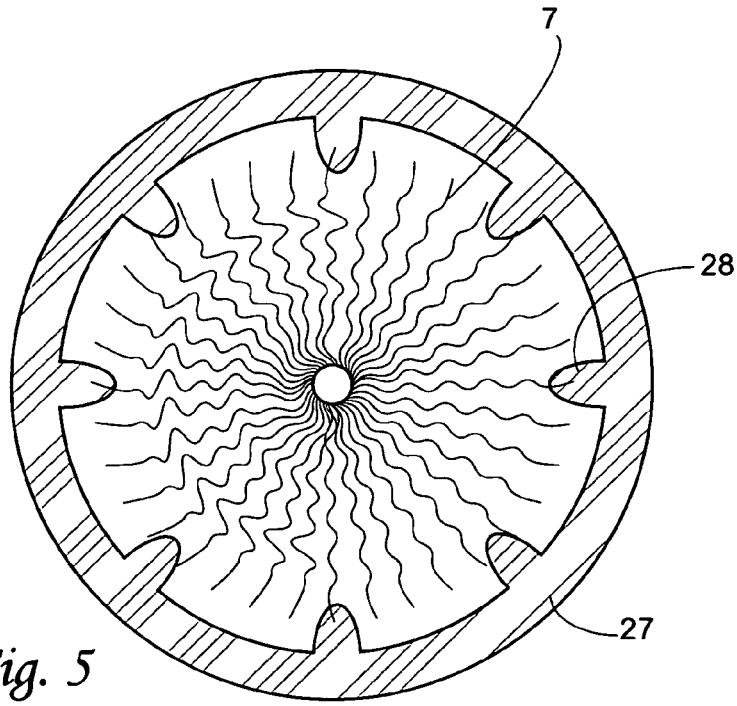
FIG. 5 shows an embodiment second chamber with ribs.

The brush 19 spins around axis 29 and also on demand can move along the axis 29 from the enclosure 31 to the chamber 22 and back. The device operation includes two operational phases: a phase P for purification and a phase C for brush self-cleaning. When air is purified (phase P) in the first section 21, it enters via inlet 10 and exits via outlet 11 while the spinning brush 19 is positioned inside the enclosure 31. In phase C, the brush shifts for self-cleaning to chamber 22, where it also spins. The second chamber may contain elongated ribs 28 (see also FIG. 5) which brush against bristles 7 while the brush 19 rotates. There is no or little charge differential between the bristles and chamber 22. Dirt is dislodged from the bristles and collected between the ribs. Periodically, chamber 22 may be removed and cleaned. It may also be made disposable. After phase C, the brush 19 moves back to the first chamber 21 for the next phase P to purify air.

Figure 6:
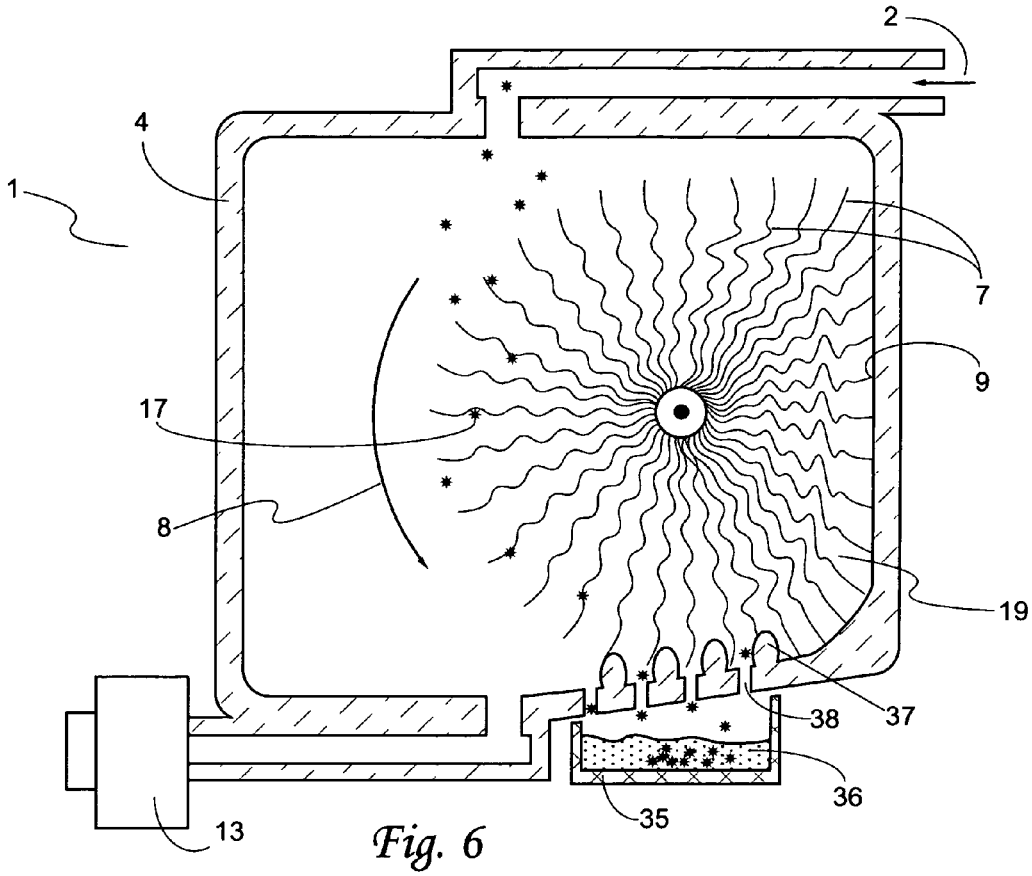
FIG. 6 shows an embodiment single-chamber air purifier with scrapping ribs.

Another version of a single-chamber air purifier is shown in FIG. 6. It contains a collecting bin 35 placed beneath the enclosure 4. The enclosure 4 contains at least one elongated rib 37 with the channels 38 positioned at or in-between the ribs 37. Soiling particles 17 that were attracted to the bristles 7 are now dislodged by the ribs 37 and fall through the channels 38 into the collecting bin 35. To retain dirt inside the collecting bin 35, the bin may be partially filled with water 36. Some disinfecting or cleaning additives may be added to water. Periodically, dirty water should be discarded and the bin 35 refilled with clean water.

Figure 7:
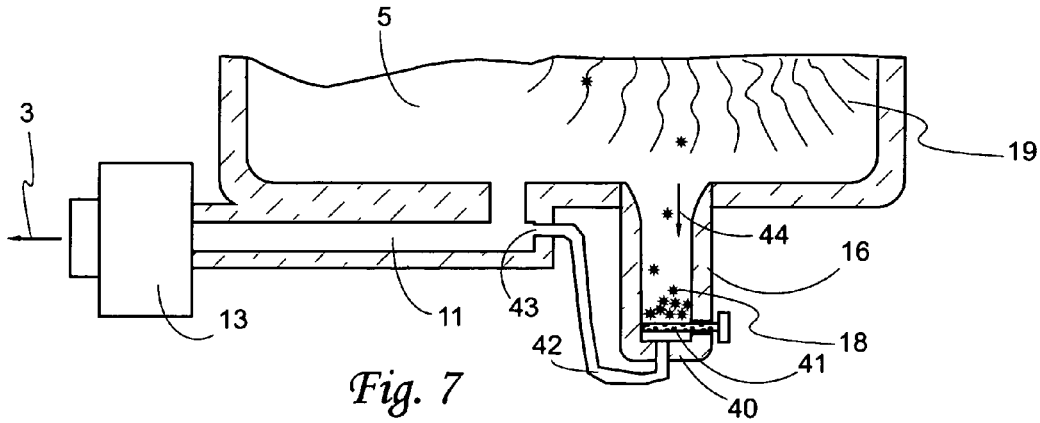
FIG. 7 illustrates an embodiment dust collecting bin with an air outlet and a conventional filter.

FIG. 7 illustrates a further improvement of the collecting bin 16 which is supplied with a conventional air filter 41 and a suction tube 42. The tube 42 is connected to the exhaust outlet 11 at opening 43. The suction tube 42 is a pneumatic connection between the bin 16 and outlet 11. Air pressure at the opening 43 is negative with respect to chamber 5 thanks to operation of blower 13. This pulls dirt in direction 44 toward the filter 41 that collects sludge 18. Filter 41 can be periodically removed and cleaned or replaced.

While the invention has been particularly shown and described with reference to a number of preferred embodiments thereof, it will be understood by those skilled in the art that various changes in form and details may be made therein without departing from the spirit and scope of the invention. Accordingly, the invention is to be limited only by the scope of the claims and their equivalents.

The invention claimed is:

1. An air cleaning device for removing contaminants from air, the air cleaning device comprising:

an enclosure defining an inner space and comprising an inlet for directing contaminated air into the inner space, and an outlet for directing cleaned air out of the inner space;

a contact surface disposed within the inner space;

a brush rotatably disposed on an axis within the inner space and capable of generating a first type of triboelectric charge;

wherein the brush is positioned with respect to the contact surface so that in a first phase at least a portion of the brush contacts the contact surface to generate a first electric charge on the at least a portion of the brush, and in a second phase the at least a portion of the brush does not contact the contact surface and electrostatically attracts contaminants in the contaminated air to generate the cleaned air; and a receptacle positioned to collect contaminants on the brush.

2. The air cleaning device of claim 1 wherein the contact surface is provided by a plate disposed within the enclosure, wherein rotation of the brush causes the at least a portion of the brush to come into contact with the plate during the first phase and not contact the plate during the second phase.

3. The air cleaning device of claim 1 wherein the brush comprises a material that develops negative triboelectric charges when contacting the contact surface.

4. The air cleaning device of claim 1 wherein the contact surface comprises a material capable of developing positive triboelectric charges when contacting the brush.

5. The air cleaning device of claim 1 wherein the receptacle is removably attached to said enclosure.

6. The air cleaning device of claim 1 further comprising at least one discharge surface positioned in the inner space in relation to the brush and the receptacle such that while in the second phase the at least a portion of the brush contacts the discharge finger and contaminants on the at least a portion of the brush are deposited into the receptacle.

7. The air cleaning device of claim 6 wherein said discharge surface is made of metal.

8. The air cleaning device of claim 1 further comprising a blower to urge the contaminated air from the inlet into the inner space and the cleaned air from the inner space to the outlet.

9. The air cleaning device of claim 8 wherein the the receptacle comprises:

a first opening for accepting contaminants from the at least a portion of the brush;

a second opening fluidly connected to the outlet; and a filter disposed between the first opening and the second opening.

10. The air cleaning device of claim 1 wherein the contact surface is provided by an internal surface of the enclosure, wherein rotation of the brush causes the at least a portion of the brush to come into contact with the internal surface during the first phase and not contact the internal surface during the second phase.

11. The air cleaning device of claim 1 wherein the inner space comprises a first chamber and a second chamber, the axis of the brush movable between the first chamber and the second chamber, and the contact surface is disposed within the first chamber and the receptacle is disposed in or provides the second chamber.

12. The air cleaning device of claim 11 wherein the second chamber comprises a surface positioned to contact the at least a portion of the brush and capable of generating negative triboelectric charges.

13. The air cleaning device of claim 12 wherein the surface of the second chamber comprises a plurality of ribs.

14. Air cleaning device of claim 1 further comprising a plurality of ribs disposed adjacent to an opening of the receptacle and positioned to come into contact with the at least a portion of the brush.

15. Air cleaning device of claim 6 wherein the discharge surface comprises a plurality of teeth.

* * * * *